US007592958B2

(12) United States Patent
Hwang et al.

(10) Patent No.: US 7,592,958 B2
(45) Date of Patent: Sep. 22, 2009

(54) MULTI-BAND ANTENNAS AND RADIO APPARATUS INCORPORATING THE SAME

(75) Inventors: Huan-sheng Hwang, Cary, NC (US); Robert A. Sadler, Duluth, GA (US)

(73) Assignee: Sony Ericsson Mobile Communications, AB, Lund (SE)

( * ) Notice: Subject to any disclaimer, the term of this patent is extended or adjusted under 35 U.S.C. 154(b) by 1021 days.

(21) Appl. No.: 10/691,150

(22) Filed: Oct. 22, 2003

(65) Prior Publication Data

US 2005/0088346 A1 Apr. 28, 2005

(51) Int. Cl.
*H01Q 1/24* (2006.01)
*H01Q 1/36* (2006.01)

(52) U.S. Cl. ..... 343/702; 343/895

(58) Field of Classification Search ..... 343/702, 343/895, 700 MS, 741, 743, 744, 764, 765, 343/725, 845, 866, 868, 871, 891, 896, 728
See application file for complete search history.

(56) References Cited

U.S. PATENT DOCUMENTS

| | | | | |
|---|---|---|---|---|
| 5,300,936 | A * | 4/1994 | Izadian | 343/700 MS |
| 5,914,692 | A * | 6/1999 | Bowers et al. | 343/742 |
| 6,005,521 | A * | 12/1999 | Suguro et al. | 343/700 MS |
| 6,054,958 | A * | 4/2000 | Holshouser et al. | 343/702 |
| 6,212,400 | B1 * | 4/2001 | Scholz | 455/575.7 |
| 6,239,755 | B1 * | 5/2001 | Klemens et al. | 343/702 |
| 6,317,086 | B1 * | 11/2001 | Woo | 343/702 |
| 6,424,300 | B1 * | 7/2002 | Sanford et al. | 343/702 |
| 6,459,916 | B1 * | 10/2002 | Suguro | 455/575.7 |
| 6,590,541 | B1 * | 7/2003 | Schultze | 343/741 |
| 6,774,856 | B2 * | 8/2004 | Back et al. | 343/702 |

(Continued)

FOREIGN PATENT DOCUMENTS

EP 0 945 917 A2 9/1999

(Continued)

OTHER PUBLICATIONS

Notification of Transmittal of the International Search Report and the Written Opinion of the International Searching Authority, or the Declaration, PCT/US2004/020802, Nov. 23, 2004.

(Continued)

*Primary Examiner*—Douglas W Owens
*Assistant Examiner*—Minh D A
(74) *Attorney, Agent, or Firm*—Myers Bigel Sibley & Sajovec, P.A.

(57) ABSTRACT

An antenna for a radio communications device includes a ground plane and a conductor loop overlying the ground plane. A monopole extends off the ground plane, and the monopole and the conductor loop are coupled at a common feedpoint. In some embodiments, the conductor loop is rectangular. In further embodiments, the antenna may further include a helical element arranged coaxial with the monopole and coupled to the common feedpoint. The ground plane, the conductor loop, the monopole and the helical element may be configured to provide a desirable voltage standing wave ratio (VSWR) over a wide frequency range of frequencies used for cellular telephony, global positioning services, and ad hoc wireless networking. Radio communications devices incorporating such antennas are also described.

25 Claims, 16 Drawing Sheets

U.S. PATENT DOCUMENTS

| | | | | |
|---|---|---|---|---|
| 6,822,614 | B2 * | 11/2004 | Chiu | 343/741 |
| 6,990,363 | B2 * | 1/2006 | Ito et al. | 455/575.5 |
| 2003/0117325 | A1 * | 6/2003 | Jo et al. | 343/702 |
| 2004/0125020 | A1 * | 7/2004 | Hendler et al. | 343/700 MS |
| 2004/0263403 | A1 * | 12/2004 | Zafar et al. | 343/713 |

FOREIGN PATENT DOCUMENTS

| | | | |
|---|---|---|---|
| EP | 1 237 224 | A1 | 9/2002 |
| GB | 2 347 560 | A | 9/2000 |
| JP | 2001-230613 | A | 8/2001 |
| JP | 2003008329 | | 1/2003 |

OTHER PUBLICATIONS

Communication pursuant to Article 94(3) EPC (4 pages) corresponding to European Patent Application No. 04756314.3; Dated: Dec. 16, 2008.

* cited by examiner

MULTI-BAND ANTENNAS AND RADIO APPARATUS INCORPORATING THE SAME

BACKGROUND OF THE INVENTION

The present invention relates to radio communications, and more particularly, to radio communications antennas and radio communications devices incorporating the same.

Wireless terminals, such as cellular telephones and wireless-capable laptop computers and personal digital assistants (PDAs), are now commonly designed to operate in multiple frequency ranges. For example, many cellular telephones are now designed for dual-band or triple-band operation in GSM and CDMA modes at nominal frequencies of 850 MHz, 900 MHz, 1800 MHz and/or 1900 MHz. It is also becoming desirable for such devices to also provide service in other bands, such as the bands used for GPS (Global Positioning Service) and Bluetooth wireless ad hoc networking.

Multiple antennas with separate feedpoints are commonly used to provide such multi-band capabilities. For example, the SonyEricsson T206 model wireless phone includes two separate antennas, one for the 850/1900 MHz bands and one for GPS; the Sony Ericsson model Z1010 phone has one antenna that works at GSM900/1800/UMTS (the frequency range of UMTS is 1920-1980 MHz for transmitting and 2110-2170 MHz for receiving) and a separate antenna for Bluetooth communications; the SonyEricsson model T68i phone has one antenna for 900/1800/1900 MHz and a separate antenna for Bluetooth communications; and the SonyEricsson T616 phone has respective separate antennas for 850/1800/1900 MHz and Bluetooth.

In light of the increasing number of frequencies over which wireless terminals are expected to operate, there is a need for antennas that provide desirable operating characteristics in multiple frequency bands.

SUMMARY OF THE INVENTION

In some embodiments of the present invention, a radio communications antenna includes a ground plane and a conductor loop overlying the ground plane. A monopole extends off the ground plane, and the monopole and the conductor loop are configured to be coupled at a common feedpoint. In some embodiments of the present invention, the conductor loop has a reflective feature, such as a corner, therein.

In further embodiments of the present invention, the conductor loop is rectangular. The conductor loop may be arranged substantially parallel to the ground plane, and the monopole may be substantially parallel to the conductor loop. The monopole may be coupled to the conductor loop at a corner thereof. In some embodiments, the ground plane, the conductor loop and the monopole may be configured to provide a voltage standing wave ratio (VSWR) less than about 3 over a frequency range from about 1.5 GHz to about 2.5 GHz.

In further embodiments of the present invention, the conductor loop is positioned adjacent an edge of the ground plane, and the monopole extends off the edge of the ground plane. The ground plane may comprise a conductive layer on a printed circuit substrate. The common feedpoint may comprise a pad on the printed circuit substrate.

According to still further embodiments of the present invention, an antenna may further include a helical element arranged coaxial with the monopole and coupled to the common feedpoint. The ground plane, the conductor loop, the monopole and the helical element may be configured to provide a voltage standing wave ratio (VSWR) less than about 3 over a frequency range from about 1.5 GHz to about 2.5 GHz and a VSWR less than 3 over a frequency range from about 800 MHz to about 900 MHz. In some embodiments, the monopole comprises a retractable monopole configured to extend and retract through the helical element and configured to connect to the common feedpoint in an extended position. The helical element may be configured to disconnect from the common feedpoint when the retractable monopole is in the extended position and configured to connect to the common feedpoint to the common feedpoint when the retractable monopole is in a retracted position.

In some embodiments of the present invention, the ground plane comprises a rectangular ground plane, the conductor loop comprises a rectangular conductor loop having a side substantially aligned with a shorter side of the rectangular ground plane, and the monopole comprises a substantially linear conductor that extends substantially perpendicular to the edge of the ground plane from a coupling point at a corner of the rectangular conductor loop at the edge of the ground plane. In certain embodiments, the conductor loop has dimensions of about 18 mm by about 8 mm, has a longer side thereof substantially aligned with the edge of the ground plane, and is separated from the ground plane by a distance in a frequency range from about 5 mm to about 10 mm, and the monopole has a length of about 36 mm. The ground plane may comprise a substantially rectangular ground plane having a length greater than about 110 mm and a width greater than about 40 mm. A helical element may be wrapped around the monopole and coupled to the common feedpoint.

According to other embodiments of the present invention, a radio communications device comprises a frame, a radio communications circuit supported by the frame, and a conductive ground plane supported by the frame. A conductor loop is supported by the frame and overlies the ground plane. A monopole is supported by the frame and extends off the ground plane. The monopole and the conductor loop are configured to be coupled to the radio communications circuit at a common feedpoint. The conductor loop may have a reflective feature therein, e.g., the conductor loop may be rectangular. The ground plane, the conductor loop and the monopole may be configured to provide a voltage standing wave ratio (VSWR) less than about 3 over a frequency range from about 1.5 GHz to about 2.5 GHz. A helical element may be arranged coaxial with the monopole and coupled to the common feedpoint, and the ground plane, the conductor loop, the monopole and the helical element may be configured to provide a voltage standing wave ratio (VSWR) less than about 3 over a frequency range from about 1.5 GHz to about 2.5 GHz and a VSWR less than 3 over a frequency range from about 800 MHz to about 900 MHz.

In further embodiments, the frame comprises a clamshell housing having first and second rotatably coupled portions, and the ground plane may comprise electrically coupled first and second portions disposed in respective ones of the first and second housing portions. The first and second housing portions may be mechanically joined by a hinge, and the monopole and the helical element may be positioned between the first and second housing portions and aligned substantially parallel to an axis of rotation of the hinge.

According to additional embodiments of the present invention, a radio communications device comprises a frame, a radio communications circuit supported by the frame, and an antenna electrically coupled to the radio communications circuit, supported by the frame and comprising commonly fed conductor loop, monopole and helical elements. The conductor loop element may have a reflective feature therein, e.g., the conductor loop element may comprise a rectangular conductor loop. The device may further comprise a ground plane supported by the frame, and the conductor loop element may be positioned overlying the ground plane. The ground plane, the conductor loop element, the monopole element and the helical element may be configured to provide a voltage standing wave ratio (VSWR) less than about 3 over a frequency range from about 1.5 GHz to about 2.5 GHz and a VSWR less than 3 over a frequency range from about 800 MHz to about 900 MHz.

DETAILED DESCRIPTION OF EXEMPLARY EMBODIMENTS

Figure 2:
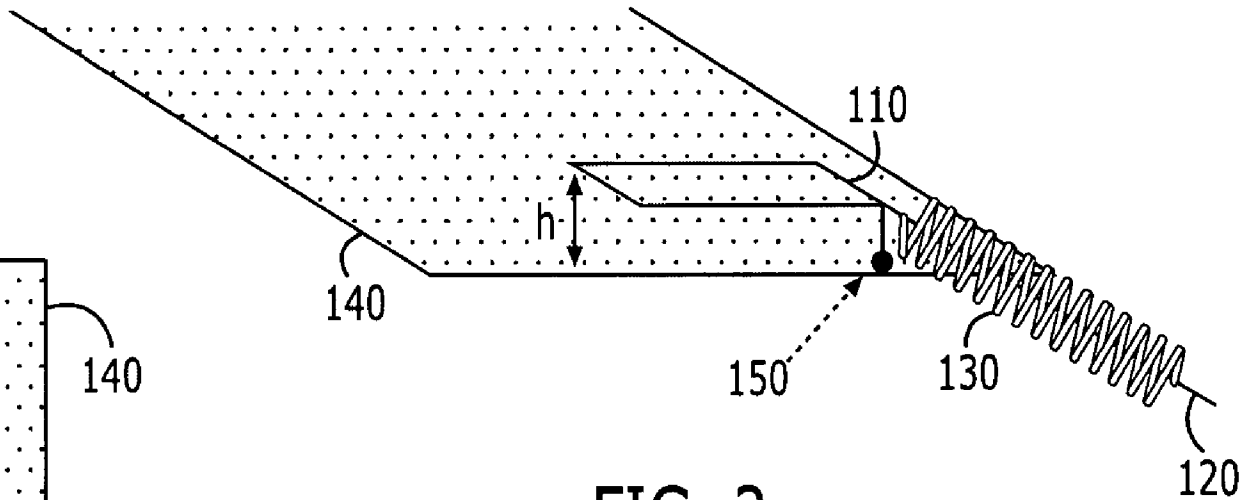
FIG. 2 is a perspective view of the antenna of FIG. 1.

Specific exemplary embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements. It will be understood that when an element is referred to as being "connected" or "coupled" to another element, it can be directly connected or coupled to the other element or intervening elements may be present.

Figure 1:
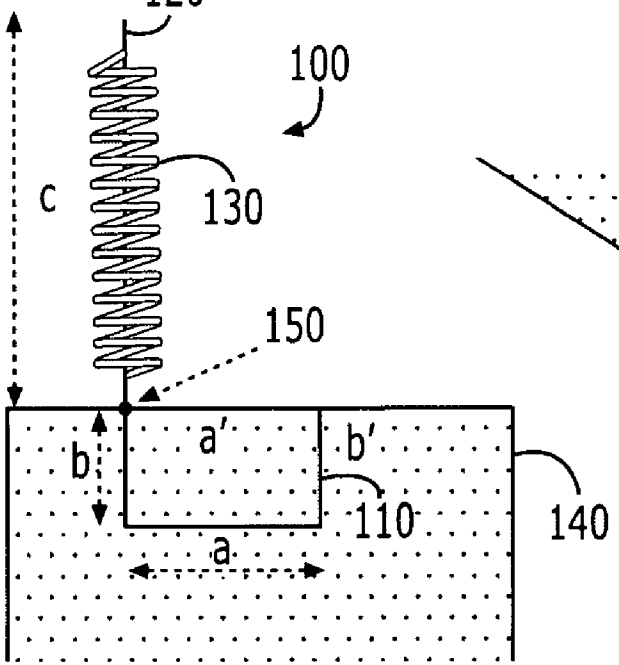
FIG. 1 is a plane view of an antenna according to some embodiments of the present invention.

FIGS. 1 and 2 illustrate an antenna 100 according to some embodiments of the present invention. The antenna includes a conductor loop 110 coupled to a monopole 120 having a length c at a common feedpoint 150. The conductor loop 110 is positioned overlying and substantially parallel to a ground plane 140 and separated therefrom by a distance h. As shown, the conductor loop 110 is shown as having a generally rectangular configuration with side dimensions a, a', b, and b'. As shown, the antenna 100 further includes a helical element 130 that is wrapped around (e.g., coaxial with) the monopole 120 and also coupled to the common feedpoint 150. As will be explained in greater detail below, the helical element 130 may be included or omitted in various embodiments of the present invention depending, for example, on whether a lower frequency operating band is desired.

Figure 3:
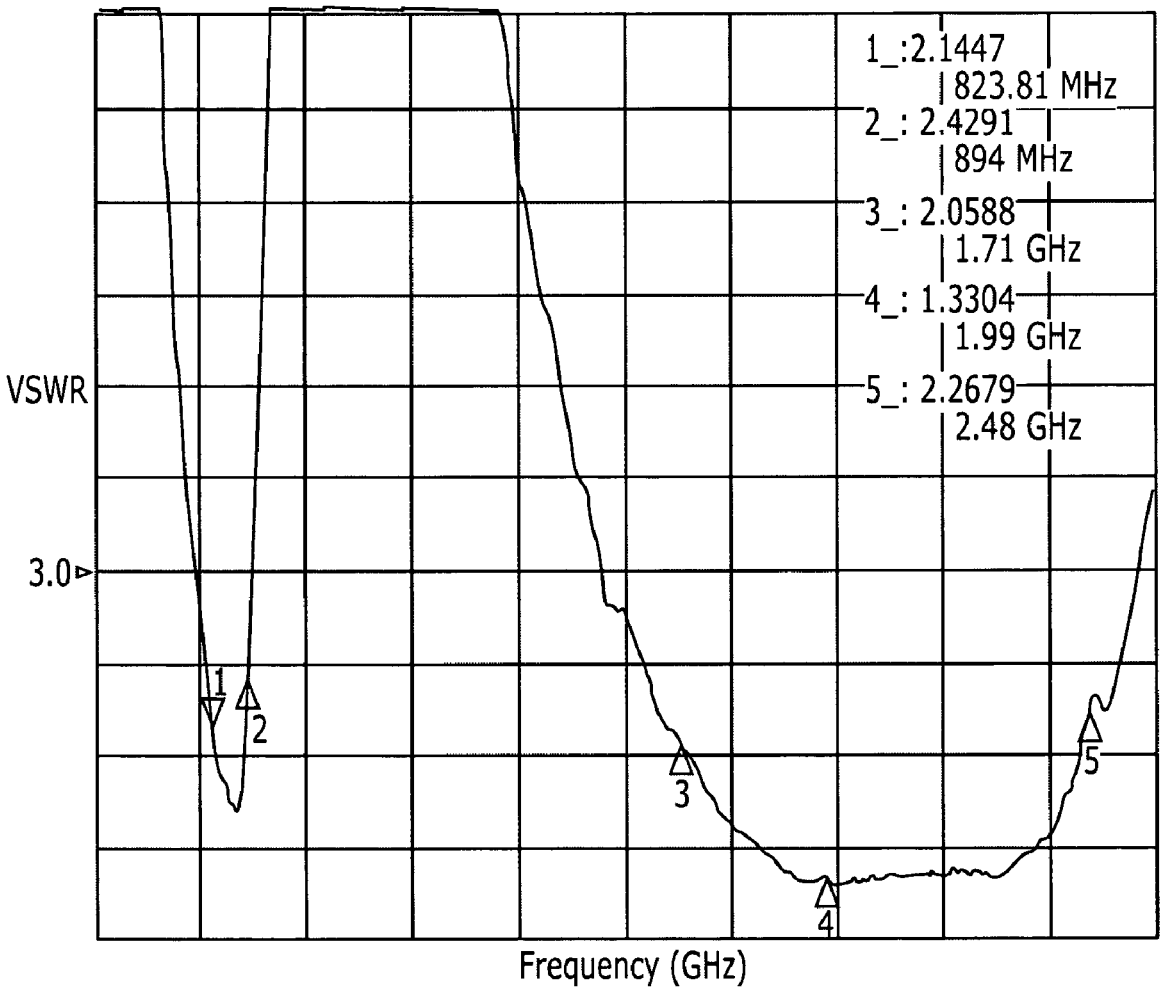
FIG. 3 is a voltage standing wave ratio (VSWR) plot for an antenna according to some embodiments of the present invention.

Reference now is made to FIG. 3, which shows a VSWR plot for a prototype antenna configured along the lines illustrated in FIGS. 1 and 2, wherein the ground plane 140 is rectangular with dimensions of 110 mm by 40 mm, and wherein the dimensions a, a', b, b' are as follows:

a=a'=18 mm;
b=b'=8 mm;
c=36 mm; and
h=5 to 10 mm.

The common feed 150 is provided using a 50-ohm feed pad on a printed circuit board on which the ground plane 140 is formed. It will be appreciated that a radio communications circuit (not shown), e.g., a receiver, transmitter or transceiver, may be attached to the feed point to communicate radio signals via the antenna 100.

As can be seen in FIG. 3, the prototype antenna exhibits a desirable VSWR that is 3 or less in a frequency range from about 1.5 GHz to about 2.5 GHz, which encompasses GPS, DCS, PCS, UMTS and Bluetooth frequencies. This may be attributable to the combination of the conductor loop and the monopole, i.e., the conductor loop induces a resonance in itself and the monopole at these frequencies due to reflections caused by a corner in the conductor loop.

Still referring to FIG. 3, according to further embodiments of the present invention, a helical element may be added to provide an additional band in a frequency range from around 800 MHz to around 900 MHz. For example, as shown in FIG. 3, the helical element 130 can provide a desirable VSWR less than 3 over a frequency range from about 800 MHz to around 900 MHz. Measurements performed on the prototype antenna having the configuration describe above indicate the following gain characteristics:

1.3 dBi at 849 MHz;
−0.5 dBi at 1.575 GHz;
0.5 dBi at 1.71 GHz;
1.8 dBi at 1.85 GHz;
2.0 dBi at 1.99 GHz;
0.5 dBi at 2.11 GHz; and
2.0 dBi at 2.45 GHz.

Figure 4:
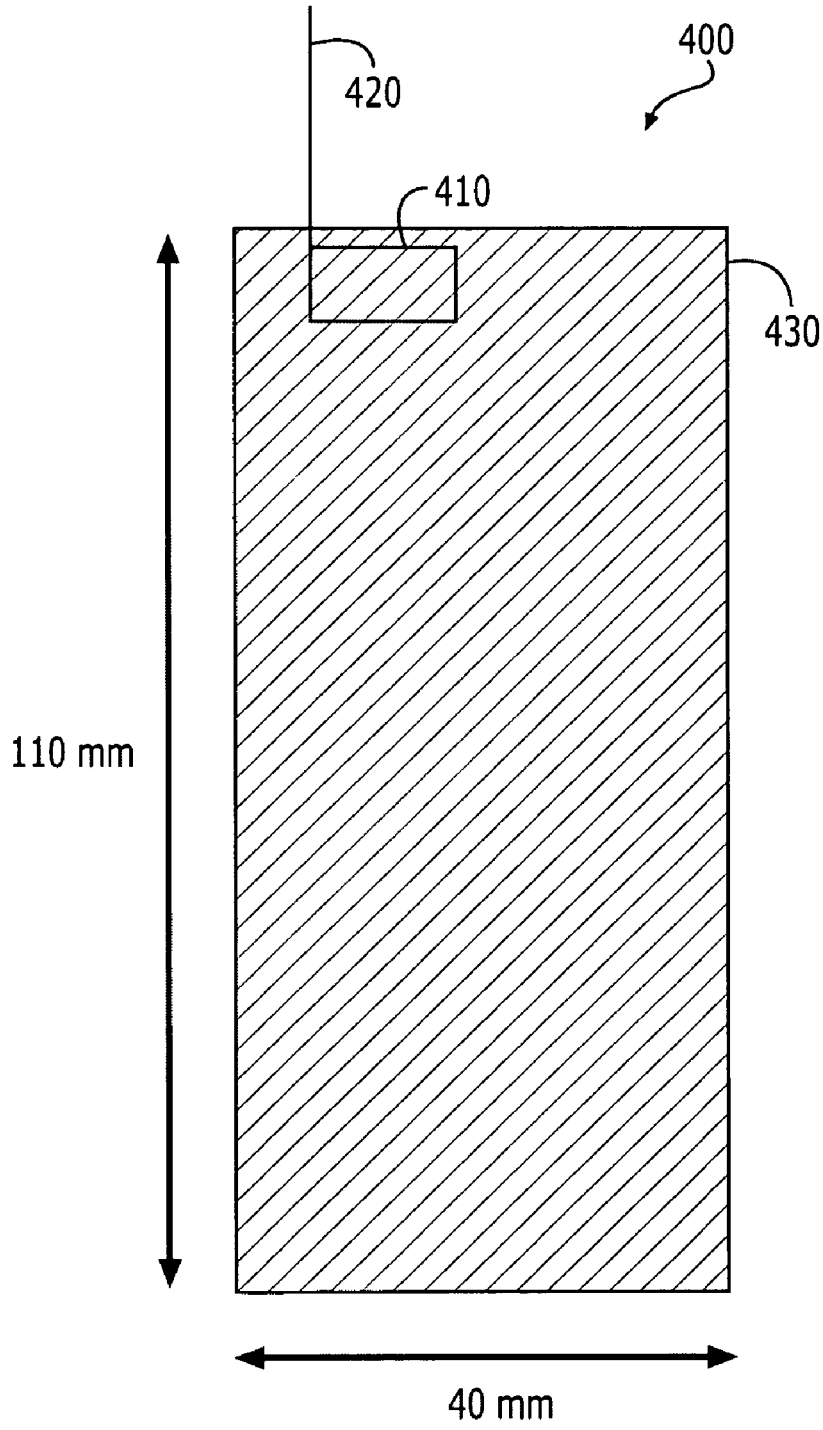
FIG. 4 is a diagram of an antenna configuration suitable for use with a cellular telephone according to some embodiments of the present invention.
Figure 5:
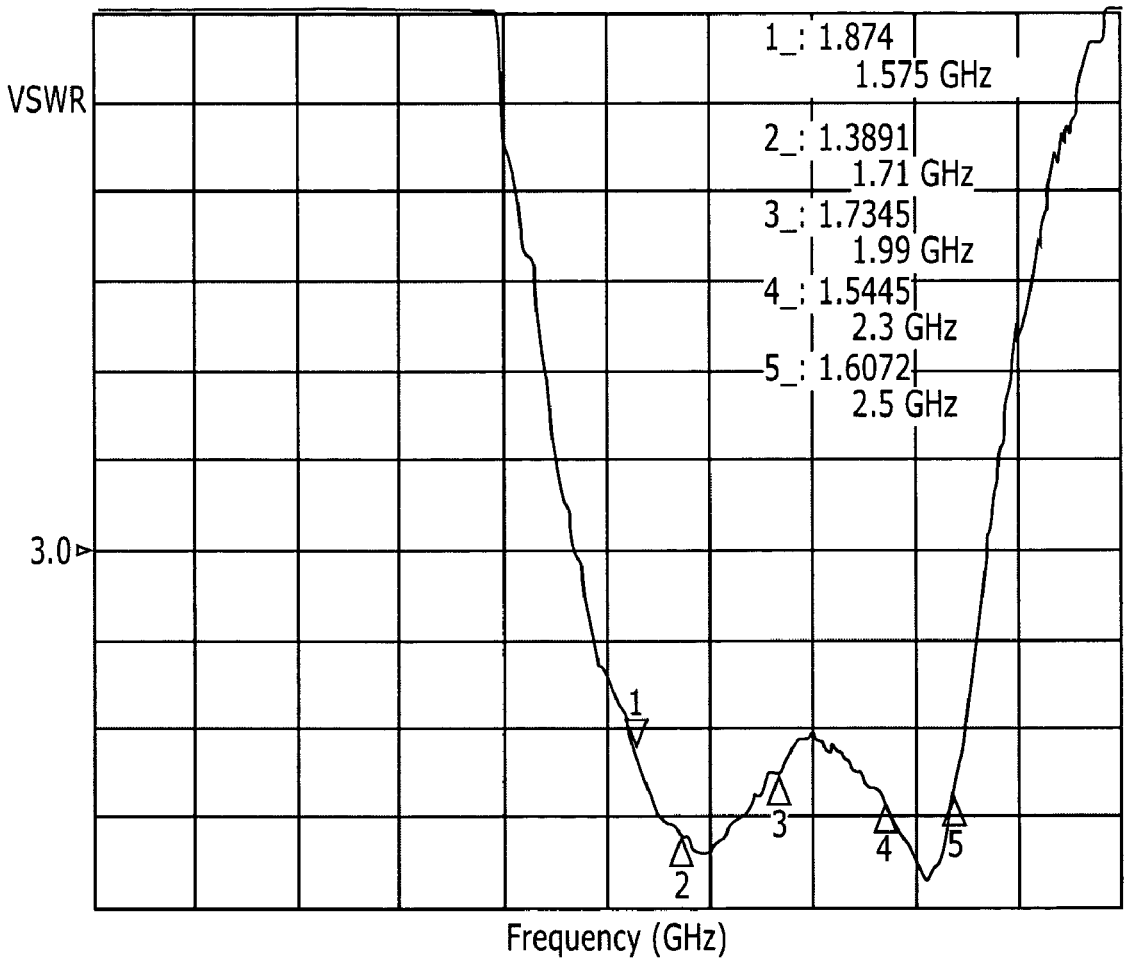
FIG. 5 is a VSWR plot for the antenna of FIG. 4.
Figure 6:
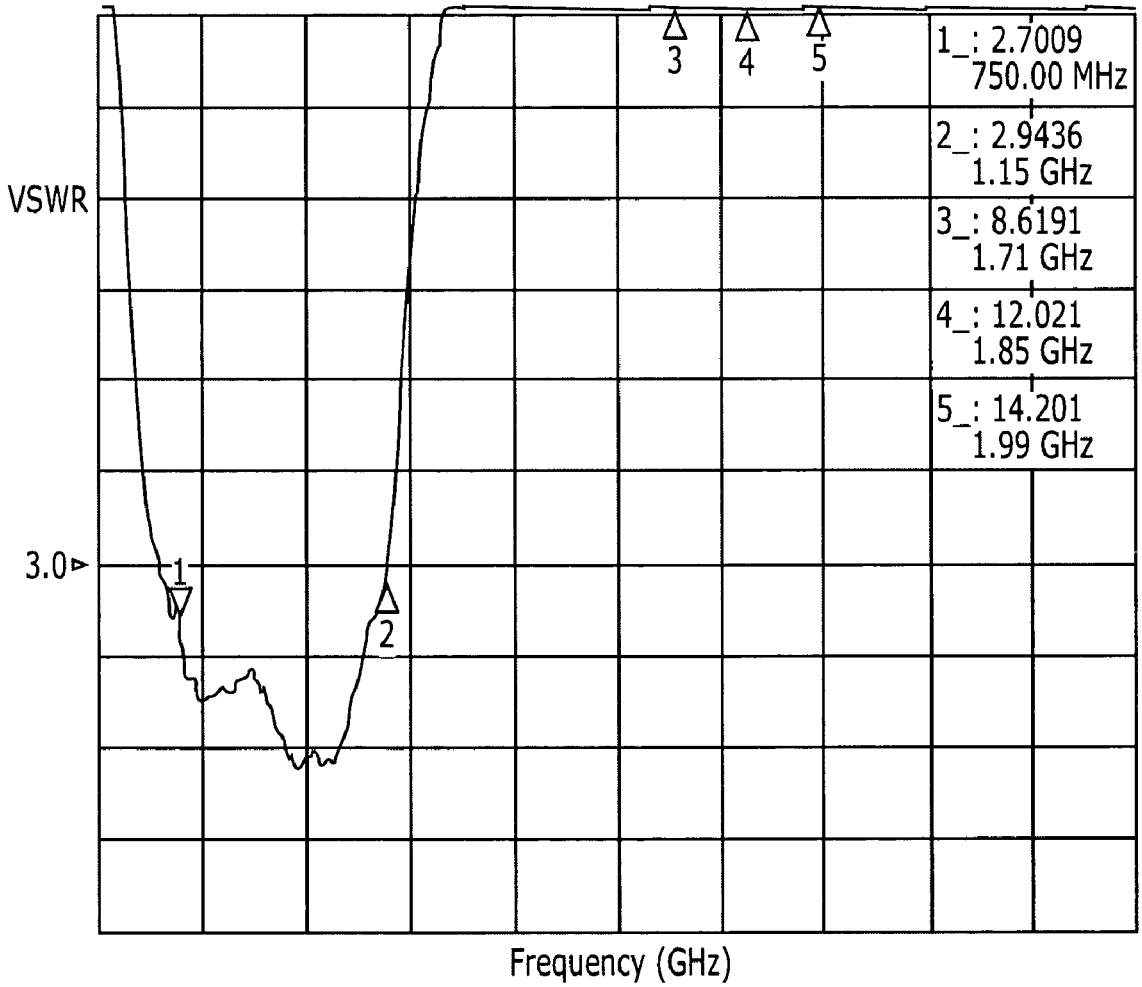
FIG. 6 is a VSWR plot for an antenna having modified dimensions according to further embodiments of the present invention.

FIG. 4 illustrates an antenna 400 according to further embodiments of the present invention, including a commonly-fed monopole 420 and rectangular conductor loop 410 overlying a rectangular ground plane 430 having dimensions of 40 mm by 110 mm formed on a substrate. Such a configuration may be suitable for use in, for example, a non-folding (bar-type) cellular telephone. As can be seen, the antenna 400 does not include a helical antenna. FIG. 5 illustrates VSWR characteristics for such an antenna. FIG. 6 illustrates a VSWR characteristic of a modification of the antenna 400 wherein antenna dimensions are doubled to have 50% bandwidth at a center resonant frequency of around 900 MHz, i.e. the bandwidth covers from about 700 MHz to about 1100 MHz.

Figure 7:
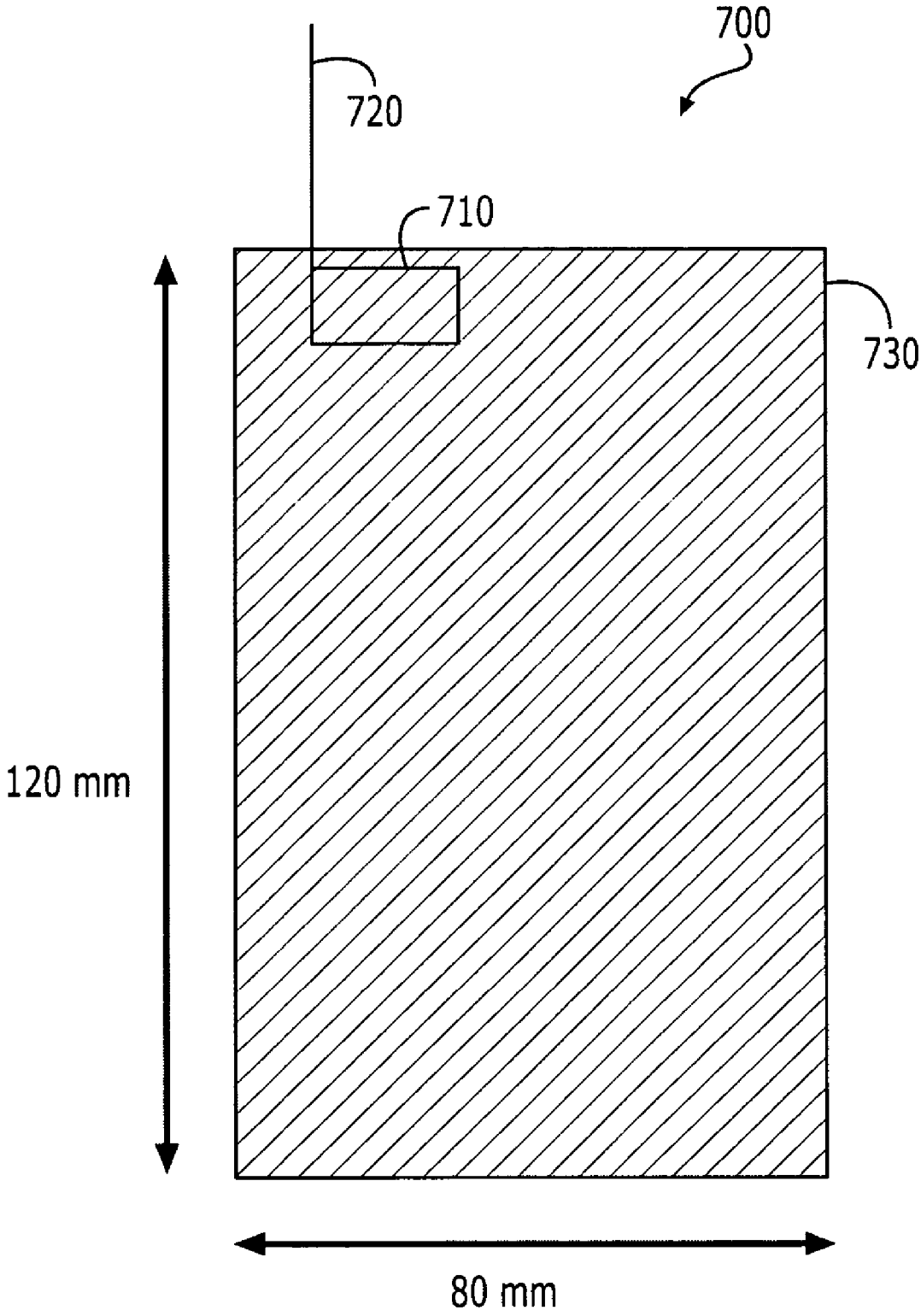
FIG. 7 is a diagram of an antenna configuration suitable for use with a wireless PDA telephone according to some embodiments of the present invention.
Figure 8:
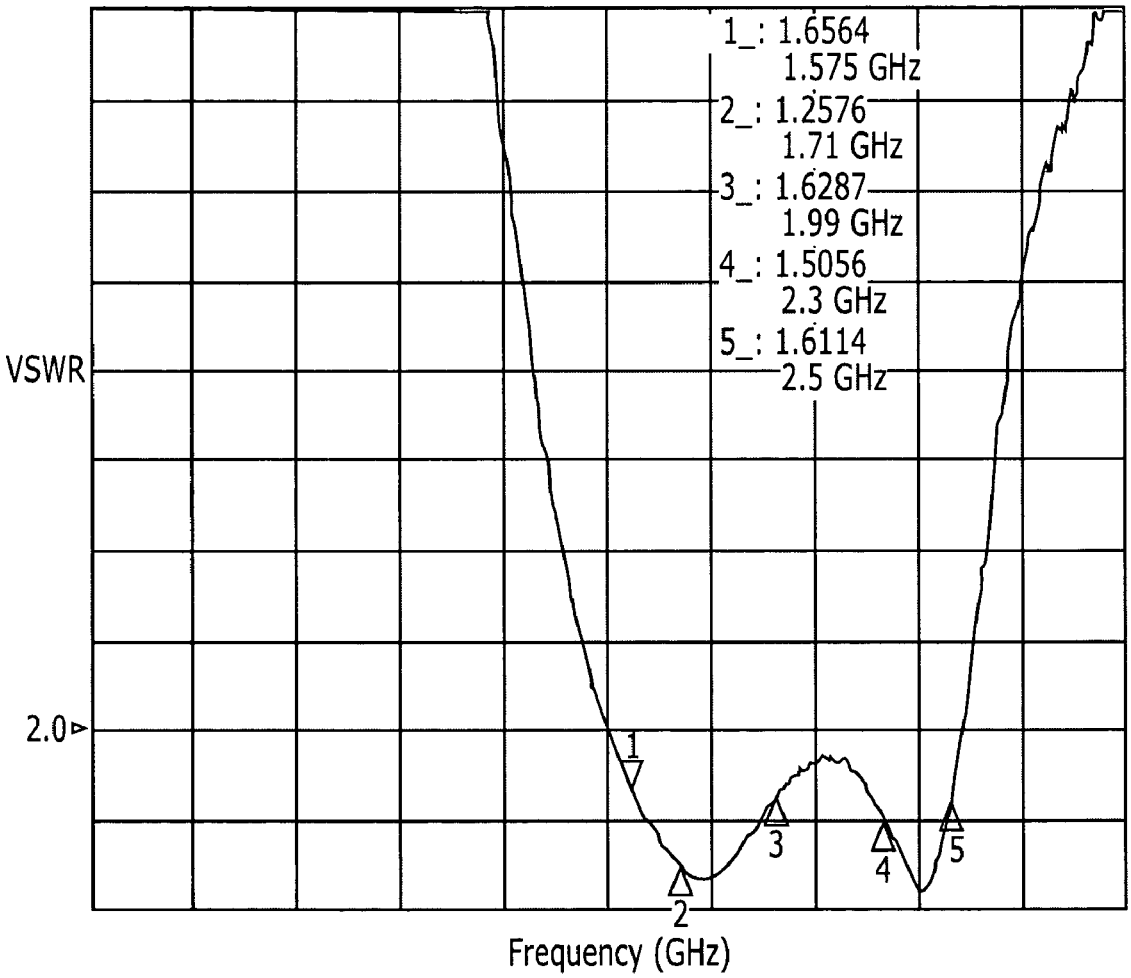
FIG. 8 is a VSWR plot for the antenna of FIG. 7.

FIG. 7 illustrates an antenna 700 according to further embodiments of the invention, including a commonly-fed monopole 720 and rectangular conductor loop 710 overlying a rectangular ground plane 730 having dimensions of 80 mm by 120 mm formed on a substrate. Such a configuration may be suitable for use in, for example, a wireless PDA. FIG. 8 illustrates VSWR characteristics for such an antenna.

Figure 9:
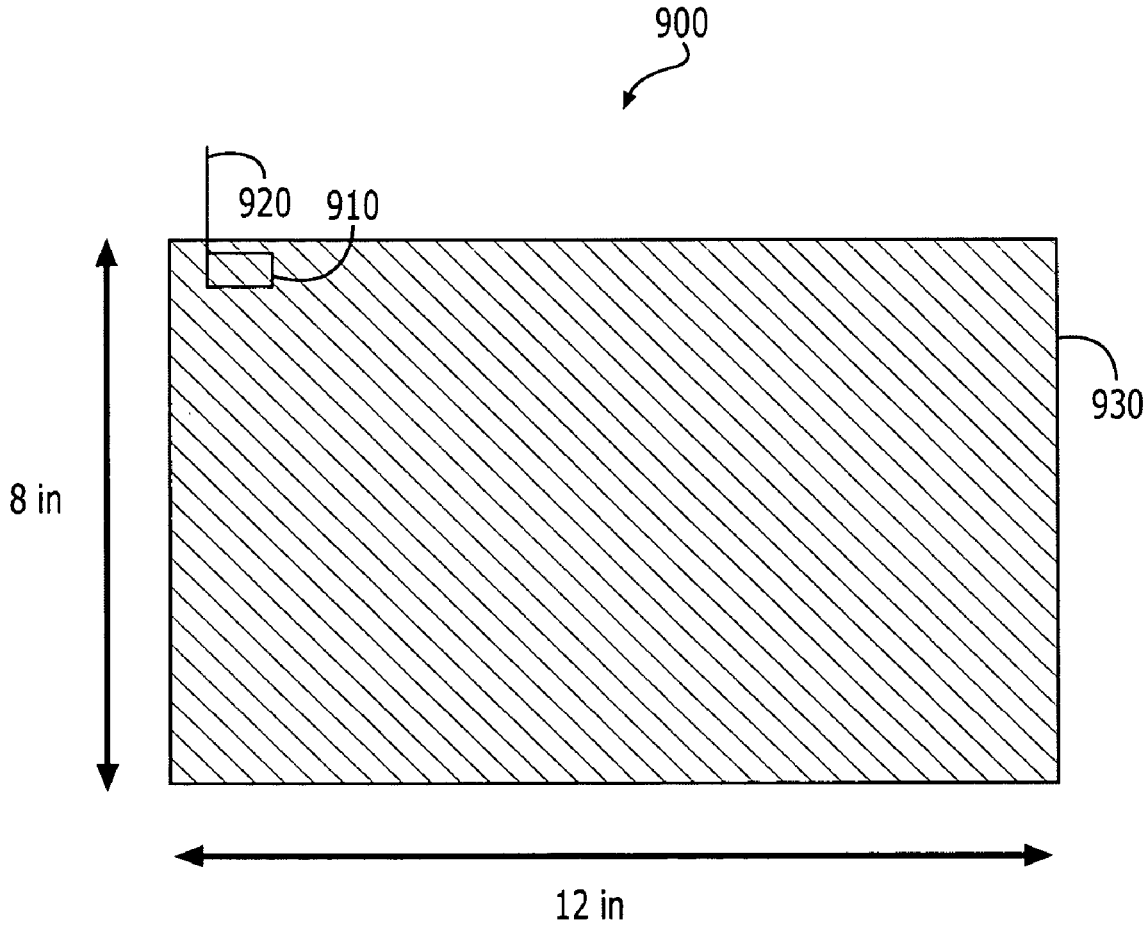
FIG. 9 is a diagram of an antenna configuration suitable for use with a laptop computer according to some embodiments of the present invention.
Figure 10:
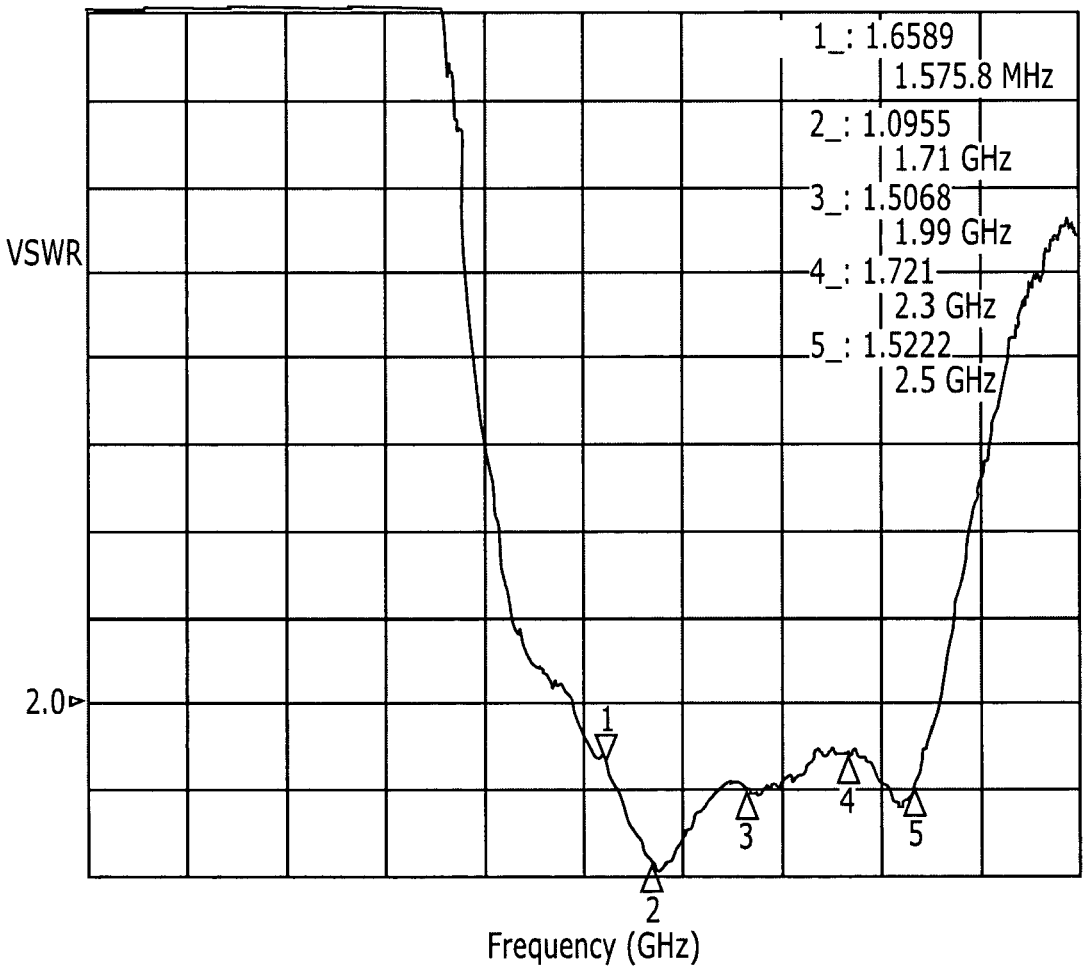
FIG. 10 is a VSWR plot for the antenna of FIG. 9.

FIG. 9 illustrates an antenna 900 according to further embodiments of the invention, including a commonly-fed monopole 920 and rectangular conductor loop 910 overlying a rectangular ground plane 630 having dimensions of 8 in by 12 in formed on a substrate. Such a configuration may be suitable for use in, for example, a laptop or notebook computer. FIG. 10 illustrates VSWR characteristics for such an antenna.

Figure 11:
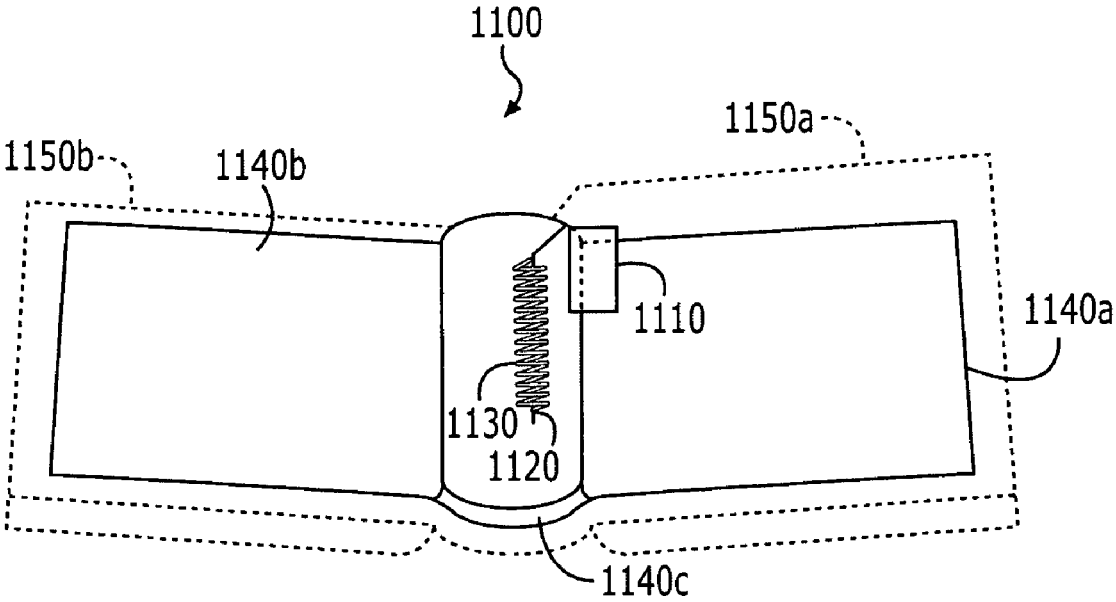
FIG. 11 illustrates an antenna configuration suitable for use in a clamshell housing according to further embodiments of the present invention.
Figure 12:
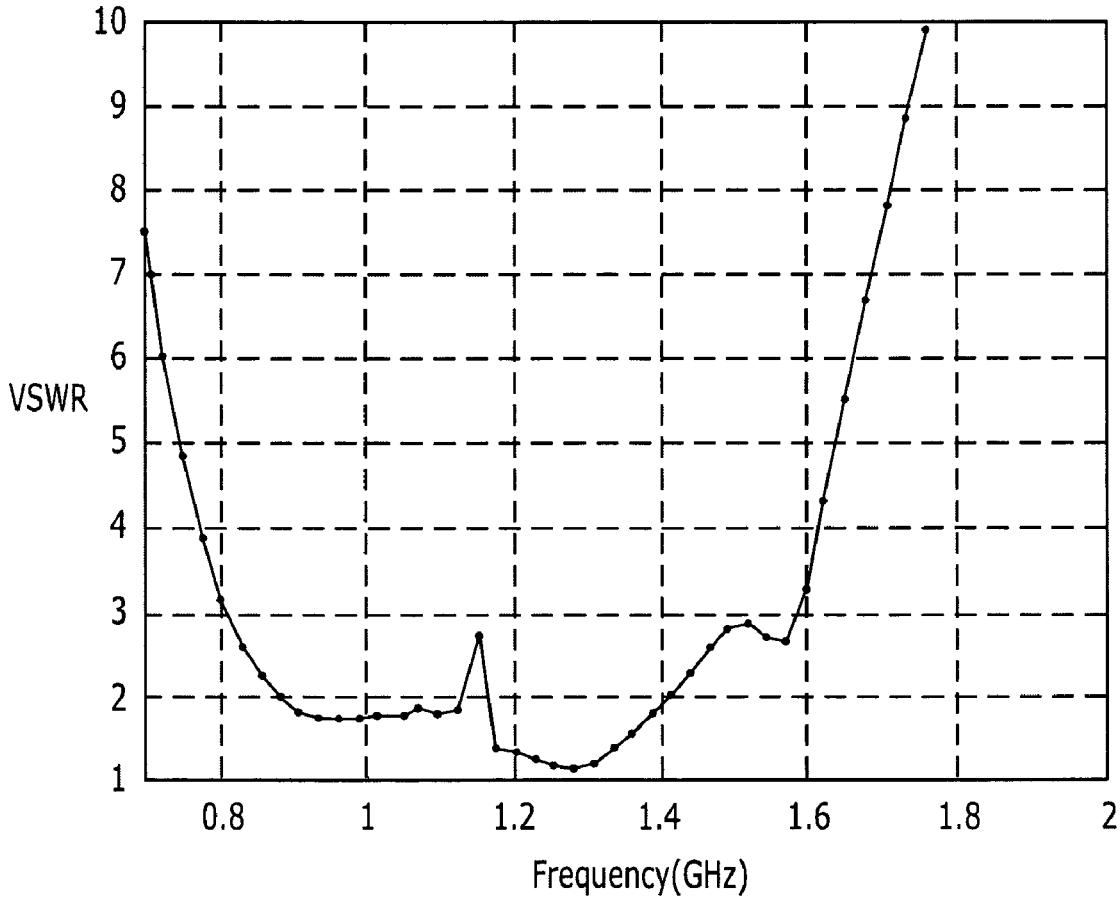
FIG. 12 is a VSWR plot for the antenna of FIG. 11.

FIG. 11 illustrates an antenna arrangement according to further embodiments of the present invention, in particular, one suitable for use in an radio communications device, such as a cellular telephone, that has a frame in the form of a clamshell housing comprising first and second housing portions 1150*a*, 1150*b* that are rotatably coupled by a hinge (not shown). An antenna 1100 includes a commonly fed monopole 1120 and rectangular conductor loop 1110 overlying a first ground plane portion 1140*a* that is housed in the first clamshell housing portion 1150*a*. A second ground plane portion 1140*b* is housed in the second clamshell housing portion 1150*b* and is coupled to the first ground plane portion 1140*a* by a ground plane conductor 1140*c*. A helical element 1130 is commonly fed with the monopole 1120 and the conductor loop 1110, and is arranged coaxial with the monopole 1120. As shown, the monopole 1120 and the helical element 1130 are arranged to extend off the ground plane portion 1140*a*, and are arranged parallel to an axis of rotation of the clamshell hinge that joins the housing portions 1150*a*, 1150*b*. It will be appreciated that a radio communications circuit (not shown) may be included in the housing 1150*a*, 1150*b* and connected to a common feedpoint of the conductor loop 1110, monopole 1120 and helical 1130 elements. FIG. 12 illustrates simulated VSWR for the antenna configuration of FIG. 11.

Figure 13:
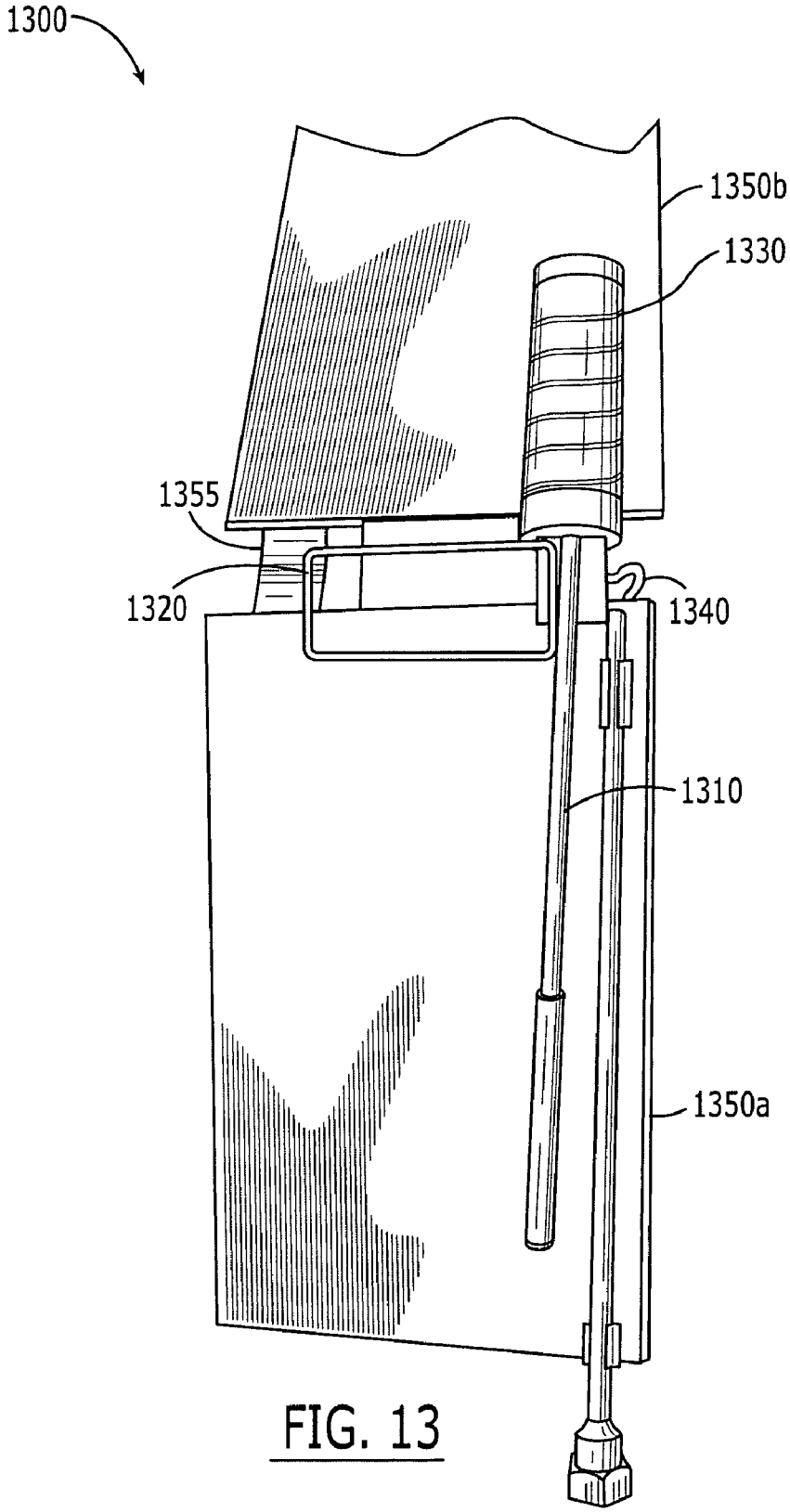
FIG. 13 illustrates a retractable antenna configuration suitable for use in a clamshell communications device according to further embodiments of the invention in a retracted position.
Figure 14:
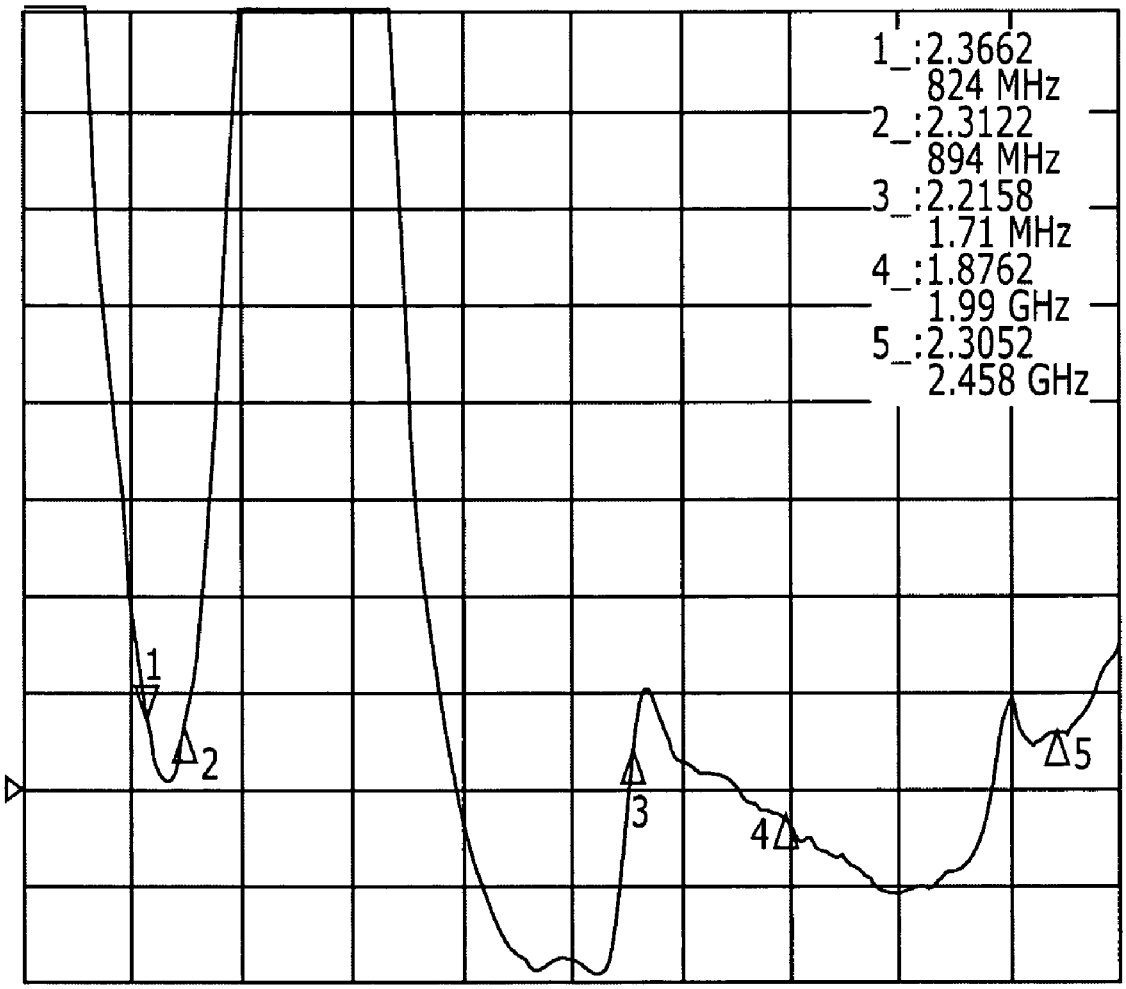
FIG. 14 is a VSWR plot for the retracted antenna of FIG. 13.
Figure 15:
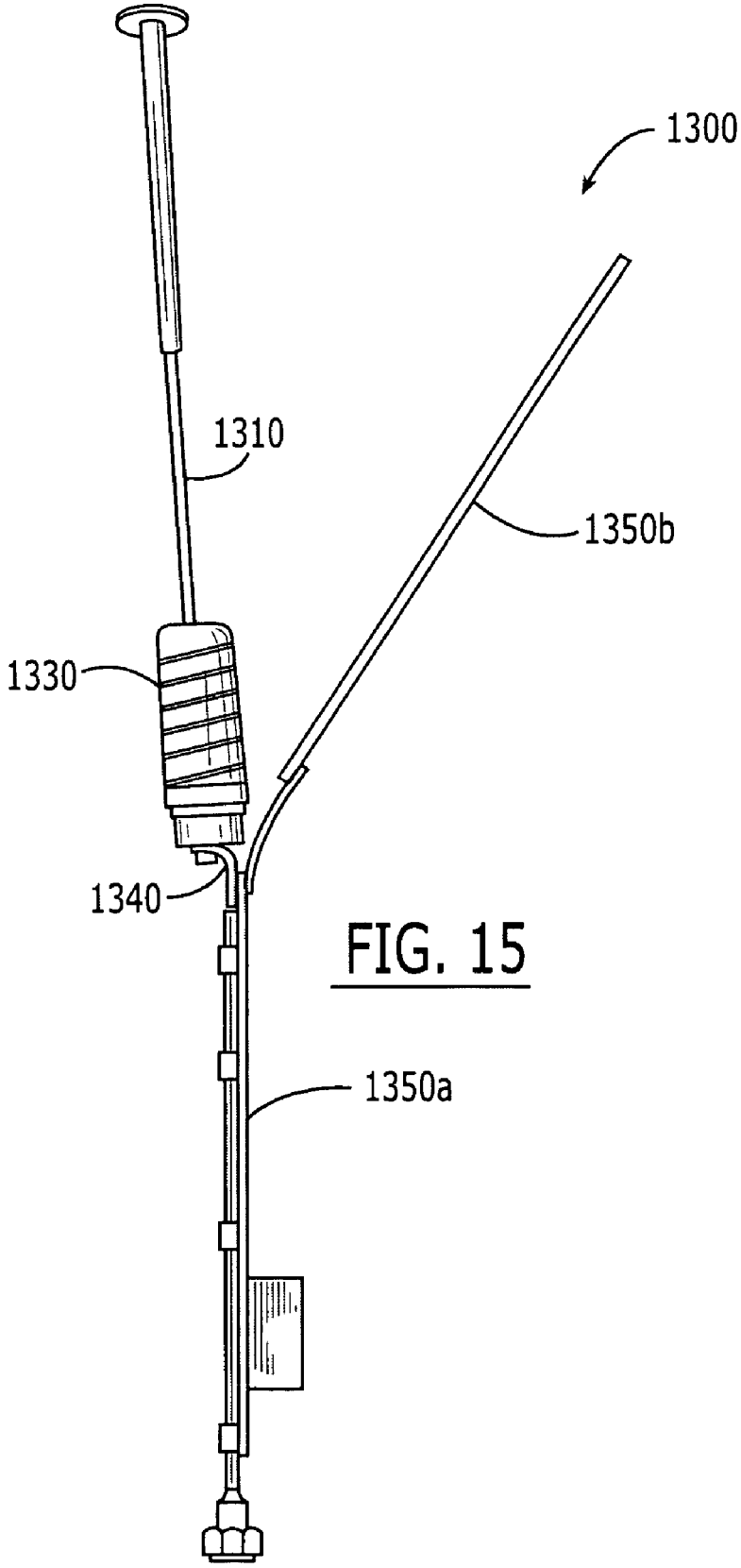
FIG. 15 illustrates the retractable antenna of FIG. 13 in an extended position.
Figure 16:
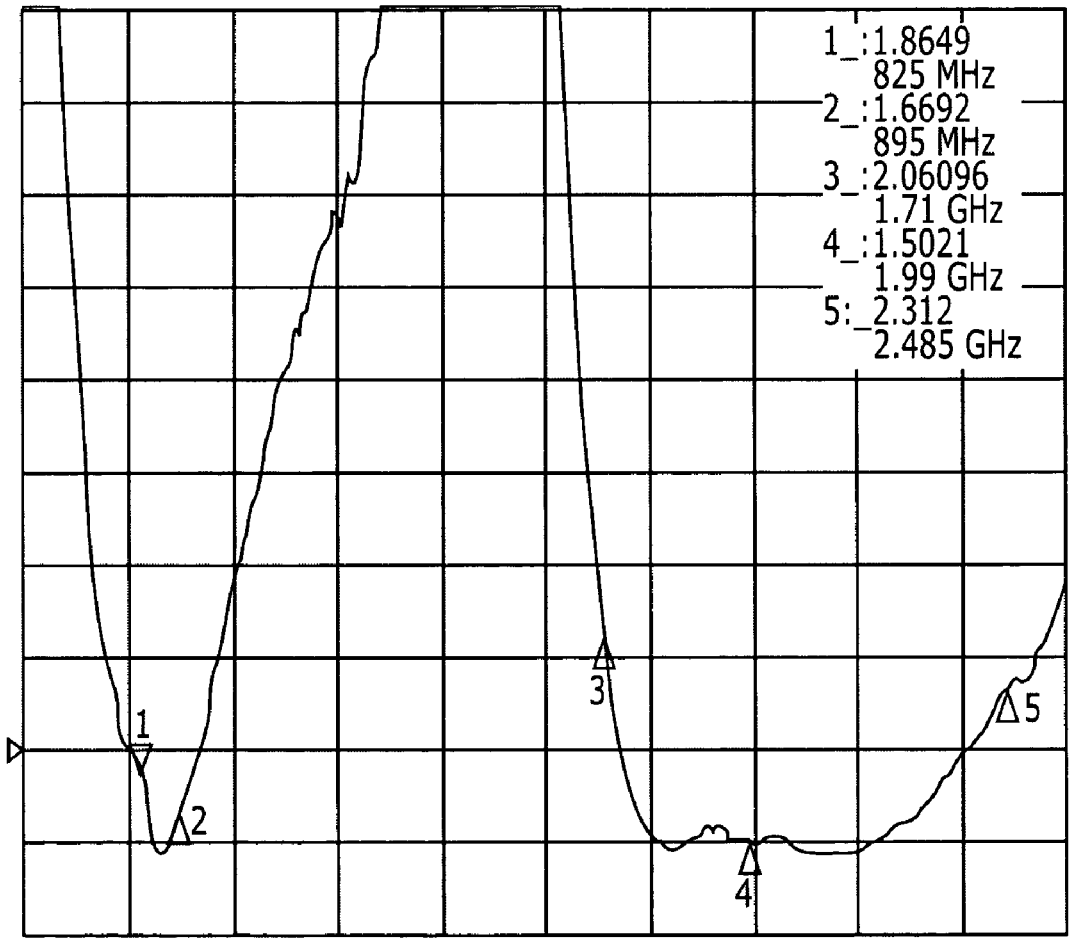
FIG. 16 is a VSWR plot for the extended antenna of FIG. 15.

FIG. 13 illustrates an antenna arrangement according to further embodiments of the present invention, in particular, a retractable antenna 1300 suitable for use in a radio communications device, such as a cellular telephone. The antenna 1300 includes a retractable monopole 1310, a helical element 1330, and a rectangular conductor loop 1320. These elements are configured to be feed from a feed 1340. The conductor loop 1320 overlies a first ground plane portion 1350*a*, which is connected to a second ground plane portion 1350*b* by a ground plane conductor 1355. It will be appreciated that a radio communications circuit (not shown) may be coupled to the feed 1340. FIG. 14 illustrates simulated VSWR for the antenna 1300 for the retracted position shown in FIG. 13. FIG. 15 illustrates the antenna 1300 in an extended position, and FIG. 16 illustrates simulated VSWR for the antenna 1300 in the extended position.

When the retractable monopole 1310 is in the retracted position (FIG. 13), the helical element 1330 is connected to the loop 1320 and the common feed 1340, and the monopole 1310 is disconnected. As shown in FIG. 14, this produces a VSWR less than 2.5 across 850 MHz, GPS, 1800 MHz, 1900 MHz, UMTS and BT bands. When the monopole 1310 is fully extended as shown in FIG. 15, the monopole 1310 is connected to the loop 1320 and the feed 1340, and the helical element 1330 is disconnected. The corresponding VSWR is less than 2.6 across the 850 MHz, 1800 MHz, 1900 MHz, UMTS and BT bands, as shown in FIG. 16.

The retractable monopole 1310 may comprise a quarter-wave monopole (e.g., for 850 or 900 MHz band), while the helical element 1330 may be dual-band for 850/1900 MHz or 900/1800 MHz bands. The combination of the monopole 1310, the loop 1320 and the helical element 1330 may be used for a combination of 850/1800/1900/UMTS/BT bands or a combination of 900/1800/1900/UMTS/BT bands. The dimensions of the loop 1320 may be similar to those of the loop of FIGS. 1 and 2. The configuration illustrated in FIGS. 13 and 15 may be particularly advantageous when used in a clamshell device (e.g., a cellphone). In particular, when a device employing the antenna 1300 is in an open position, a user may pull the retractable monopole 1310 in, for example, a rural area or fringe area, to improve communication of the device.

Figure 17:
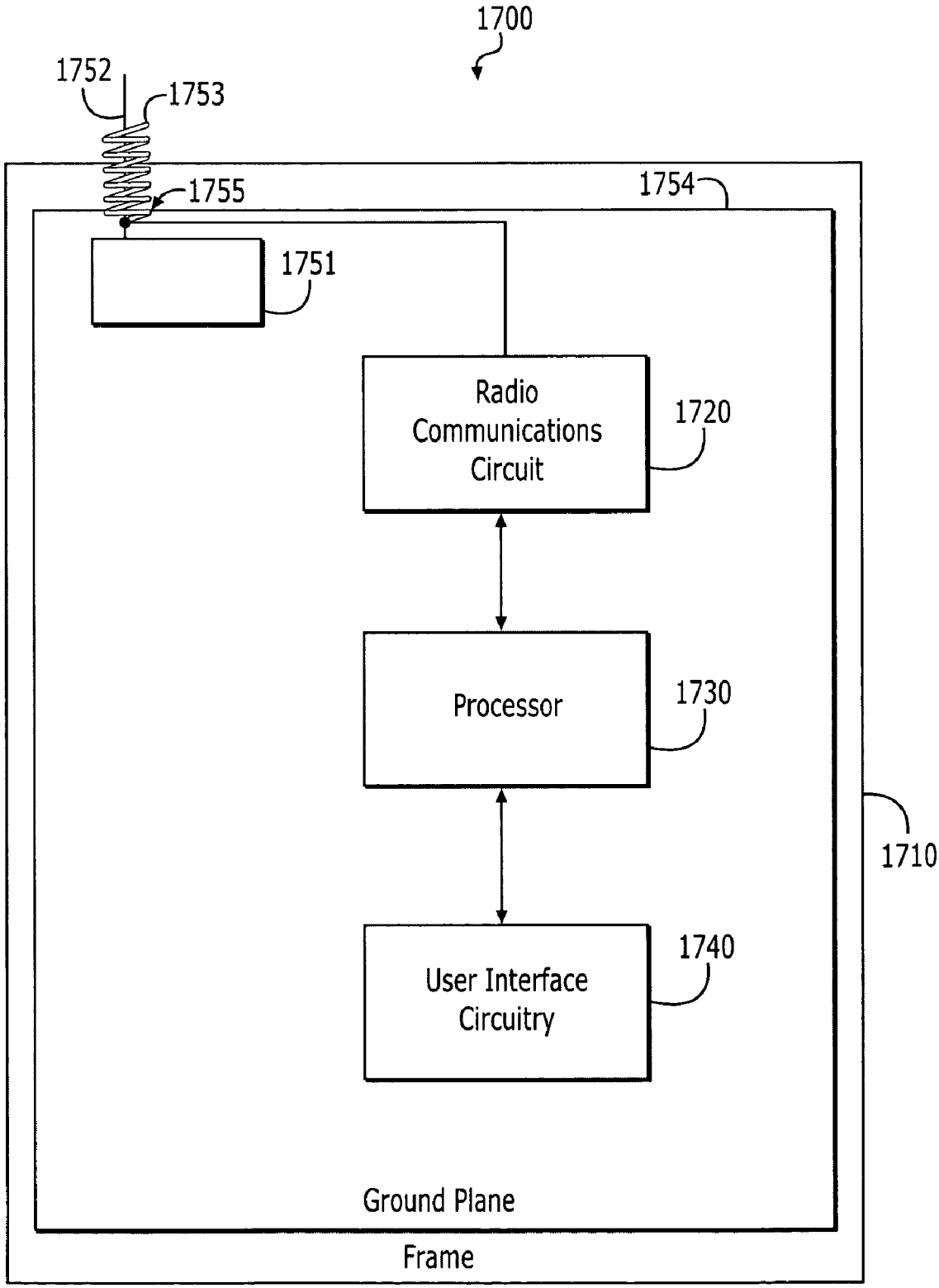
FIG. 17 illustrates a radio communications device according to further embodiments of the present invention.

FIG. 17 illustrates a radio communications device 1700 according to further embodiments of the present invention. The device 1700 includes a frame 1710 (e.g., a housing or other support structure) that supports a radio communications circuit 1720. The radio communications circuit 1720 may be operatively coupled to other electronic components, such as a processor 1730 and user interface circuitry 1740. It will be appreciated that these components may be arranged in a number of different ways. The radio communications circuit 1720 is coupled to a common feedpoint 1755 for a conductor loop 1751 (overlying a ground plane 1754), a monopole 1752 and a helical antenna element 1753. It will be appreciated that the device 1700 may take a number of forms, including, but not limited to, a mobile terminal (MT) device (e.g. a cellular telephone), a PDA, a desktop computer, a laptop computer, a notebook computer, a PCMCIA card, and a PCI bus card.

In the drawings and specification, there have been disclosed exemplary embodiments of the present invention. Although specific terms are employed, they are used in a generic and descriptive sense only and not for purposes of limitation, the scope of the invention being defined by the following claims.

That which is claimed:

1. An antenna, comprising:

a rectangular ground plane;

a rectangular conductor loop overlying the ground plane and having a side substantially aligned with an edge of the rectangular ground plane; and a monopole comprising a substantially linear conductor that extends substantially perpendicular to the edge of the ground plane from a coupling point at a corner of the rectangular conductor loop at the edge of the ground plane, wherein the conductor loop has dimensions of about 18 mm by about 8 mm, has a longer side thereof substantially aligned with the edge of the ground plane, and is separated from the ground plane by a distance in a frequency range from about 5 mm to about 10 mm; and wherein the monopole has a length of about 36 mm.

2. An antenna according to claim 1, wherein the ground plane comprises a substantially rectangular ground plane having a length greater than about 110 mm and a width greater than about 40 mm.

3. A radio communications device, comprising:

a frame;

a radio communications circuit supported by the frame;

a conductive ground plane disposed on a substrate supported by the frame;

a conductor loop supported by the frame and overlying the ground plane; and a monopole supported by the frame and extending off the ground plane from a location overlying the ground plane, wherein the monopole and the conductor loop are configured to be commonly coupled to the radio communications circuit at a common feedpoint.

4. A device according to claim 3, wherein the conductor loop has a reflective feature therein.

5. A device according to claim 4, wherein the reflective feature comprises a corner.

6. A device according to claim 5, wherein the conductor loop is rectangular.

7. A device according to claim 6, wherein the conductor loop is substantially parallel to the ground plane.

8. A device according to claim 6, wherein the monopole is substantially parallel to the conductor loop.

9. A device according to claim 6, wherein the monopole is coupled to the conductor loop at a corner thereof.

10. A device according to claim 6, wherein the ground plane, the conductor loop and the monopole are configured to provide a voltage standing wave ratio (VSWR) less than about 3 over a frequency range from about 1.5 GHz to about 2.5 GHz.

11. A device according to claim 6, wherein the conductor loop is positioned adjacent an edge of the ground plane, and wherein the monopole extends off the edge of the ground plane.

12. A device according to claim 6, wherein the ground plane is disposed on a printed circuit substrate, and wherein the common feedpoint comprises a pad on a printed circuit substrate.

13. A device according to claim 6, further comprising a helical element arranged coaxial with the monopole and coupled to the common feedpoint.

14. A device according to claim 13, wherein the ground plane, the conductor loop, the monopole and the helical element are configured to provide a voltage standing wave ratio (VSWR) less than about 3 over a frequency range from about 1.5 GHz to about 2.5 GHz and a VSWR less than 3 over a frequency range from about 800 MHz to about 900 MHz.

15. A device according to claim 13 wherein the ground plane comprises a rectangular ground plane;

wherein the conductor loop comprises a rectangular conductor loop having a side substantially aligned with a shorter side of the rectangular ground plane; and wherein the monopole comprises a substantially linear conductor that extends substantially perpendicular to the edge of the ground plane from a coupling point at a corner of the rectangular conductor loop at the edge of the ground plane.

16. A device according to claim 15 wherein the conductor loop has dimensions of about 18 mm by about 8 mm, has a longer side thereof substantially aligned with the edge of the ground plane, and is separated from the ground plane by a distance in a frequency range from about 5 mm to about 10 mm; and wherein the monopole has a length of about 36 mm.

17. A device according to claim 15, wherein the ground plane comprises a substantially rectangular ground plane having a length greater than about 110 mm and a width greater than about 40 mm.

18. A device according to claim 13, wherein the frame comprises a clamshell housing having first and second rotatably attached portions, wherein the ground plane comprises electrically coupled first and second portions disposed in respective ones of the first and second housing portions.

19. A device according to claim 18, wherein the first and second housing portions are mechanically joined by a hinge, and wherein the monopole and the helical element are positioned between the first and second housing portions and are aligned substantially parallel to an axis of rotation of the hinge.

20. A device according to claim 18, wherein the monopole comprises a retractable monopole configured to extend and retract through the helical element and configured to connect to the common feedpoint in an extended position.

21. A device according to claim 20, wherein the helical element is configured to disconnect from the common feedpoint when the retractable monopole is in the extended position and configured to connect to the common feedpoint to the common feedpoint when the retractable monopole is in a retracted position.

22. A mobile terminal, comprising:

a frame;

a radio communications circuit supported by the frame;

a ground plane supported by the frame; and an antenna electrically coupled to the radio communications circuit, attached to the frame and comprising commonly fed conductor loop, monopole and helical elements, wherein the monopole element is positioned within the helical element along an axis of the helical element and wherein the conductor loop element is positioned overlying the ground plane.

23. A mobile terminal according to claim 22, wherein the conductor loop element has a reflective feature therein.

24. A mobile terminal according to claim 23, wherein the conductor loop element comprises a rectangular conductor loop.

25. A mobile terminal according to claim 22, wherein the ground plane, the conductor loop element, the monopole element and the helical element are configured to provide a voltage standing wave ratio (VSWR) less than about 3 over a frequency range from about 1.5 GHz to about 2.5 GHz and a VSWR less than 3 over a frequency range from about 800 MHz to about 900 MHz.

* * * * *

UNITED STATES PATENT AND TRADEMARK OFFICE

CERTIFICATE OF CORRECTION

PATENT NO. : 7,592,958 B2
APPLICATION NO. : 10/691150
DATED : September 22, 2009
INVENTOR(S) : Hwang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1125 days.

Signed and Sealed this

Twenty-first Day of September, 2010

David J. Kappos

David J. Kappos
*Director of the United States Patent and Trademark Office*